US006148586A

United States Patent [19]

Jandl

[11] Patent Number: 6,148,586

[45] Date of Patent: Nov. 21, 2000

[54] PANEL-SHAPED BUILDING ELEMENT

[75] Inventor: Adolf Jandl, Eitweg, Austria

[73] Assignee: A. Jandl Patentholding KEG, Eitweg, Austria

[21] Appl. No.: 09/051,586

[22] PCT Filed: Sep. 25, 1996

[86] PCT No.: PCT/AT96/00173

§ 371 Date: Apr. 15, 1998

§ 102(e) Date: Apr. 15, 1998

[87] PCT Pub. No.: WO97/14857

PCT Pub. Date: Apr. 24, 1997

[30] Foreign Application Priority Data

Oct. 18, 1995 [AT] Austria ..... 569/95 U

[51] Int. Cl.[7] ..... E04C 2/32

[52] U.S. Cl. ..... 52/783.17; 52/793.11; 52/794.1; 52/309.7

[58] Field of Search ..... 52/783.17, 783.19, 52/793.1, 793.11, 794.1, 309.7, 309.9, 309.12, 309.16

[56] References Cited

U.S. PATENT DOCUMENTS

| | | | |
|---|---|---|---|
| 2,641,029 | 6/1953 | Trimmer | 52/783.17 X |
| 3,341,395 | 9/1967 | Weber | 52/783.17 X |
| 3,364,638 | 1/1968 | Santangelo | 52/783.17 X |
| 4,052,828 | 10/1977 | Mancini et al. | 52/783.17 X |
| 4,057,944 | 11/1977 | Wyatt, Jr. et al. | 52/783.17 X |
| 4,070,839 | 1/1978 | Clem | 52/783.17 X |
| 4,147,004 | 4/1979 | Day et al. | 52/794.1 X |
| 4,346,541 | 8/1982 | Schmitt | 52/783.17 X |
| 4,593,449 | 6/1986 | Meray-Hovarth et al. | 52/793.1 X |
| 4,726,707 | 2/1988 | Newton | 52/783.17 X |
| 4,832,308 | 5/1989 | Slonimsky et al. | 52/783.17 X |
| 4,903,446 | 2/1990 | Richards et al. | 52/309.7 X |
| 4,974,381 | 12/1990 | Marks | 52/309.12 |
| 5,349,749 | 9/1994 | Fiedler | 52/783.17 X |
| 5,685,124 | 11/1997 | Jandl, Jr. | 52/783.17 X |
| 5,758,463 | 6/1998 | Mancini, Jr. | 52/309.12 |

FOREIGN PATENT DOCUMENTS

| | | | |
|---|---|---|---|
| 126762 | 5/1919 | European Pat. Off. | 52/783.17 |
| 0 054 199 | 6/1982 | European Pat. Off. . | |
| 2 220 638 | 10/1974 | France . | |
| 2 644 494 | 9/1990 | France . | |
| 18 76 219 | 7/1963 | Germany . | |
| 1 484 322 | 2/1969 | Germany . | |
| 1 909 071 | 9/1972 | Germany . | |
| 43 27 503 | 4/1994 | Germany . | |
| 44 13 953 | 12/1994 | Germany . | |
| 607214 | 8/1948 | United Kingdom | 52/783.17 |

*Primary Examiner*—Beth A. Stephan
*Assistant Examiner*—Brian E. Glessner
*Attorney, Agent, or Firm*—Young & Thompson

[57] ABSTRACT

A building panel with a folded-plate structure made of perforated, trapezoidally corrugated sheet metal, plastic foam being attached into the corrugations so as to fill them, narrow sides of the building panel run parallel to the corrugations and have diametrically opposed profiles and are formed by N branches of the folded-plate structure.

4 Claims, 1 Drawing Sheet

PANEL-SHAPED BUILDING ELEMENT

BACKGROUND OF THE INVENTION

The invention relates to a panel-shaped building element.

DESCRIPTION OF THE INVENTION

A composite element is known from DE 1 484 322 A1 which is composed of a folded-plate structure and heat insulation located on either side in the form of a plastic foam foamed into the corrugations between the legs of the folded-plate structure. The two large surfaces of the known building element are covered with a lining of cover foils.

SUMMARY OF THE INVENTION

The object of the invention is to make available, proceeding from DE 1 484 322 A1, a simplified structure of a building element, which can be used as a ceiling, wall, floor or roof element.

It is advantageous in the building element as claimed in the invention that by the corresponding selection of the shape of the folded-plate structure and optionally by the attachment of planks on one or both sides it can be matched easily and without abandoning the principle as claimed in the invention to the respective application.

The plastic foams which can be used within the framework of the invention are not limited to polyurethane or polystyrene plastics, but other foam plastics can be used to advantage, for example, those based on vegetable (rapeseed) oil.

It is especially advantageous that the folded-plate structure provided in the building component as claimed in the invention is provided with openings (holes of any shape), since then the plastic foam provided on either side of the folded-plate structure is integral over its parts which extend through the openings so that the support function of the plastic foam is increased. For openings in the folded-plate structure there is also the advantage that the plastic to be foamed in the production of the building element as claimed in the invention need be located only on one side of the folded-plate structure, and still completely fills the other side of the folded-plate structure under the action of the foaming pressure.

Other details and advantages of the panel-shaped building element as claimed in the invention follow from the description below.

DESCRIPTION OF THE PREFERRED EMBODIMENT

Figure 1:
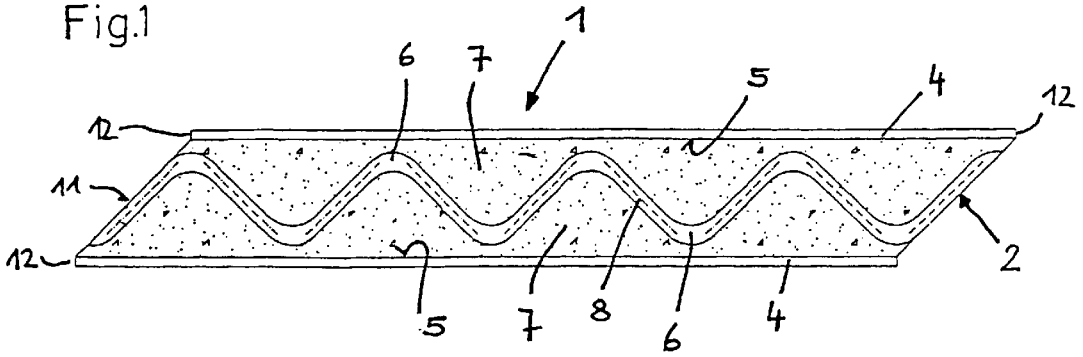
FIGS. 1 through 4 show different embodiments of the building panel in cross section.

In the embodiment of panel-shaped building element 1 as claimed in the invention (building panel), folded-plate structure 2 of wood fiber or particle material are provided with corrugations 6 and with planks 4 located on both sides. The cavities between planks 4 and branches 8 of folded-plate structure 2 which proceed from corrugations 6 are completely filled with plastic foam.

In this case plastic foam 7 which for example is a polyurethane or a polystyrene foam, is foamed into the cavities so that it not only fills the cavities, but also acts as an adhesive which fixes planks 4 to folded-plate structure 2 so that uniform, stable building panel 1 results.

Openings (holes) can be provided in branches 8 of folded-plate structure 2 so that plastic foam 7 can extend in one piece through folded-plate structure 2 and thus the strength of building panel 1 is increased.

In the embodiment shown in FIG. 1 corrugations 6 of folded-plate structure 2 do not extend as far as inner surfaces 5 of planks 4.

Figure 2:
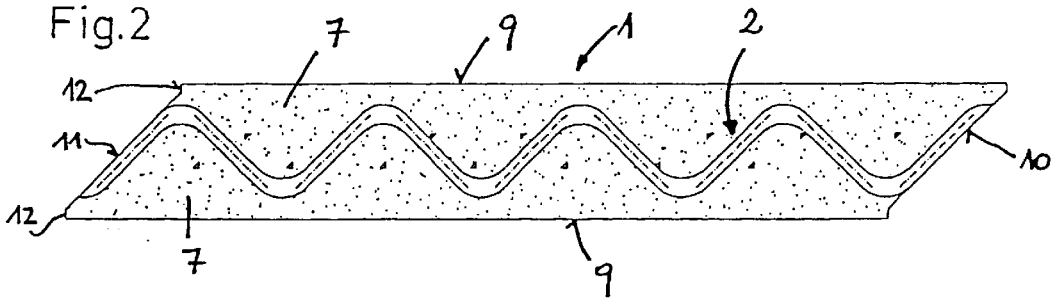

FIG. 2 shows an embodiment in which building panel 1 is made without planks 4. This embodiment is produced in a mold and has smooth outer surfaces 9 which are provided directly with a surface treatment, for example, they can be papered, painted and/or plastered. Outer surfaces 9 can however also be made with a structure matched to the surface treatment (grooved, burled, etc.).

Figure 3:
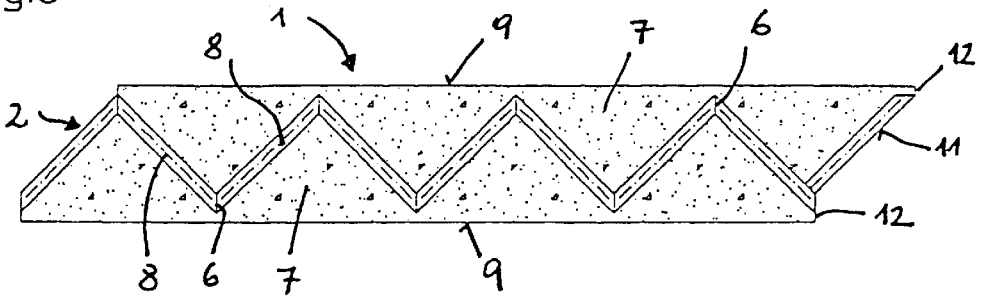

The embodiment of building panel 1 which is shown in FIG. 3 has a construction similar to FIGS. 1 and 2, here branches 8 of folded-plate structure 2 being made from wooden boards which are joined to one another in the area of corrugations 6.

Figure 4:
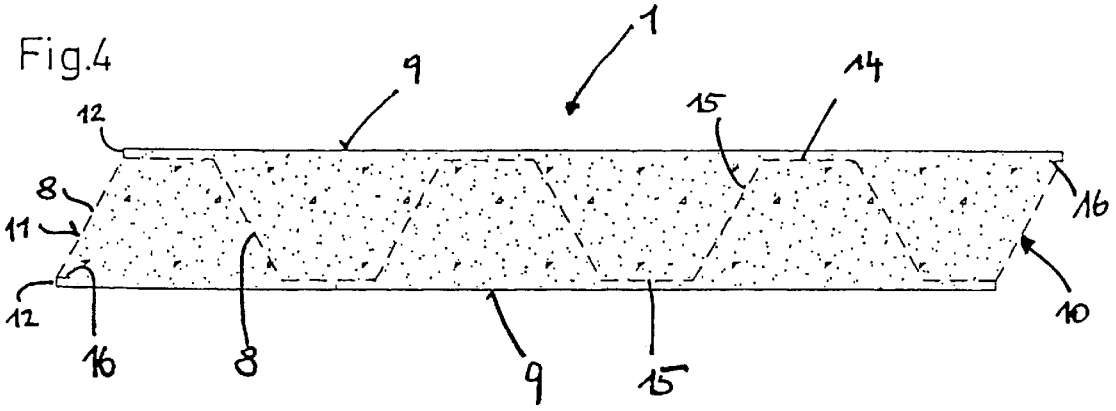

In the embodiment of building element 1 (building panel) shown in FIG. 4, folded-plate structure 2 is a corrugated sheet (for example, raw, galvanized or otherwise surface-treated steel sheet) which has openings 15, and its corrugated shape is made trapezoidal. There is an embodiment with bilateral planks 4, an embodiment with only unilateral planks 4, or an embodiment without planks (FIG. 4).

In the embodiment shown in FIG. 4, sections 14 which run parallel to the plane of building panel 1 are located at a distance from outer surfaces 9 of building panel 1 so that they are covered externally by plastic foam (polyurethane or polystyrene foam).

In the embodiment shown in FIG. 1, branches 8 of folded-plate structure 2 which lie on narrow sides 10 is angled to the inside and run parallel to the plane of building panel 1 so that ends 16 of the sheet are securely held in building panel 1.

The cavities between branches 8 of folded-plate structure 2 are completely filled with plastic foam.

It is common to the embodiments of building panel 1 as claimed in the invention which are shown in FIGS. 1 through 4 that narrow sides 10 of building panel 1 which extend perpendicular to the plane of the figure are profiled diametrically opposed, so that building panels 1—also with different structure—can be connected to one another without joints, for example by cementing. The design of narrow sides 10 is composed of inclined surface 11 and two sections 12 perpendicular to the plane of building panel 1. Here it is preferred that inclined surfaces 11 are formed by the outer surface of edge-side branch 8 of folded-plate structure 2. Sections 12 can be formed by the side edges of planks 4 (FIG. 1). In the embodiment shown in FIGS. 2, 3 and 4, the corresponding shape of the mold in which building panel 1 is produced provides for the fact that on narrow sides 10 of building panel 1 there are sections 12 which run perpendicular thereto and which are joined to one another by inclined surface 11.

In summary one embodiment of the invention can be described as follows by way of example:

Building panel 1 has folded-plate structure 2 of perforated sheet 15 which is corrugated in a trapezoidal shape, the corrugations of sheet 15 being filled with plastic foam 7 which is foamed into the corrugations. Narrow sides 10 of building panel 1 which run parallel to the corrugations are profiled diametrically opposed and are formed by end branches 8 of folded-plate structure 2. Building panel 1 can be provided on one or two sides with planks 4, or there is building panel 1 for direct surface treatment, for example, by papering or plastering. Because foam 7 is foamed into the corrugations of perforated folded-plate structure 2, high strength of building panel 1 is achieved, and planks 4 provided at best are held stationary by the plastic foam. Foam 7 can extend through folded-plate structure 2 through openings 15 in the sheet which forms folded-plate structure 2, and an increased strength of building panel 1 is achieved. Narrow sides 10 of building panel 1 are profiled diametrically opposed so that building panels 1 can be located next to one another without joints.

It is advantageous in building panel 1 that it does not act as a (latent) heat store so that the spaces bordered by the building panels as claimed in the invention can be heated or cooled quickly with low energy cost.

What is claimed is:

1. A panel-shaped building element comprising:

a folded-plate structure, said folded-plate structure comprising branches joined by corrugations and terminating with two end branches, said branches comprising openings, on profile, said branches being joined by said corrugations to define a width of said panel-shaped building element and to also define a height of said folded-plate structure, the width being greater than the height; and a foam heat insulation located on both sides of said folded-plate structure extending through said openings and completely covering from view said corrugations, wherein a width of said foam heat insulation is defined by the width of said panel-shaped building element and a height of said foam heat insulation is greater than a height of said folded-plate structure such that said foam heat insulation defines outer horizontal surfaces of said panel-shaped building element, and wherein said two end branches are arranged in parallel and define end edges of said building element.

2. The building element of claim 1, wherein said foam heat insulation is one of polyurethane foam or polystyrene foam.

3. The building element of claim 1, wherein said end edges generally run obliquely to a plane of the building element, and said end edges comprise first and second ends aligned perpendicular to the plane of the building element.

4. A panel-shaped building element comprising:

a folded-plate structure, said folded-plate structure comprising branches joined by corrugations and terminating with end branches, said branches comprising openings, on profile, said branches being joined by said corrugations to define a width of said panel-shaped building element and to also define a height of said folded-plate structure, the width being greater than the height;

a foam heat insulation located on both sides of said folded-plate structure extending through said openings and completely covering from view said corrugations; and a plank attached to a surface of said foam heat insulation defines a horizontal exterior surface of said panel-shaped building element, wherein a width of said foam heat insulation is defined by the width of said panel-shaped building element and a height of said foam heat insulation is greater that a height of said folded-plate structure such that said foam heat insulation occupies a region intermediate said plank and a corresponding set of corrugations, said end branches define building element end edges generally running obliquely to a plane of the building element, said end edges comprising first and second ends aligned perpendicular to the plane of the building element, and said heat foam insulation forms one of said first and second ends.

* * * * *